United States Patent [19]

Turner

[11] 3,961,848

[45] June 8, 1976

[54] ELECTROPHOTOGRAPHIC PRINTING MACHINE WITH HALFTONE SCREEN CLEANING

[75] Inventor: Timothy D. Turner, Webster, N.Y.

[73] Assignee: Xerox Corporation, Stamford, Conn.

[22] Filed: Apr. 11, 1975

[21] Appl. No.: 567,149

[52] U.S. Cl. ..... 355/4; 355/11; 355/67

[51] Int. Cl.[2] ..... G03G 15/22

[58] Field of Search ..... 355/3 R, 4, 11, 17, 355/71, 67; 350/61; 15/21 R, 21 B, 77, 250, 256.5

[56] References Cited

UNITED STATES PATENTS

| | | | |
|---|---|---|---|
| 3,120,790 | 2/1964 | Carlson et al. | 355/3 R |
| 3,535,036 | 10/1970 | Starkweather | 355/11 |
| 3,842,273 | 10/1974 | Van Buskirk | 317/262 A X |
| 3,866,258 | 2/1975 | De Graw | 350/61 X |

*Primary Examiner*—L. T. Hix
*Assistant Examiner*—Kenneth C. Hutchison

[57] ABSTRACT

An electrophotographic printing machine in which an adjustable screen has particles removed therefrom by a cleaning member moving thereacross.

13 Claims, 4 Drawing Figures

ELECTROPHOTOGRAPHIC PRINTING MACHINE WITH HALFTONE SCREEN CLEANING

The foregoing abstract is neither intended to define the invention disclosed in the specification, nor is it intended to be limiting as to the scope of the invention in any way.

BACKGROUND OF THE INVENTION

Generally, this invention relates to an electrophotographic printing machine, and more particularly concerns an adjustable screen being periodically cleaned to remove particle contaminants therefrom.

In a typical elecrophotographic printing machine, a photoconductive member is charged to a substantially uniform potential. The charged photoconductive member is exposed to a light image of an original document. This records an electrostatic latent image on the photoconductive member corresponding substantially to that of the original document. The electrostatic latent image is then developed with charged particles. A sheet of support material is positioned closely adjacent to the latent image and arranged to have the particles transferred thereto. After the particles are transferred to the sheet of support material, they are permanently affixed thereto forming a copy of the original document. Generally, the charged particles are heat settable so that the application of heat thereto permanently secures them to the sheet of support material.

Multi-color electrophotographic printing incorporates the features of the foregoing process. However, a plurality of single color light images are created. Successive single color light images are formed by filtering the light image of the original document. The single color light image irradiates the charged photoconductive member recording thereon an electrostatic latent image corresponding to a single color contained in the original document. A plurality of different single color electrostatic latent images are formed and developed with toner particles complementary in color to the color of the filtered light image. These powder images are transferred to the sheet of support material in superimposed registration with one another. The multilayer toner powder image is then permanently affixed to the sheet of support material by the application of heat thereto.

Hereinbefore, it has been difficult to reproduce subtle variations of tone or color. To overcome this difficulty, half-tone screens have been employed. These screens produce tone gradations by forming half-tone dots or lines of varying size. In the highlight zones, for example, the dots are small. These dots increase in size throughout the intermediate shades until they merge together in the shadow region. At the extremes, there will be complete whiteness at the highlight end of the tone scale, and solid black at the shadow end. Numerous patents teach the concept of screening. Exemplary of these patents are U.S. Pat. Nos. 2,598,732; 3,535,036; 3,121,010, 3,493,381; 3,776,633; and 3,809,555. However, these patents do not, as a rule, teach cleaning of the screen to remove particle contaminants therefrom.

It is the primary object of the present invention to improve the cleaning of a screen employed in an electrophotographic printing machine.

BRIEF SUMMARY OF THE INVENTION

Briefly stated, and in accordance with the present invention, there is provided an electrophotographic printing machine employing a photoconductive member therein.

Pursuant to the features of the present invention, a screen member is mounted movably in the printing machine. The screen member is positioned closely adjacent to the photoconductive member. A cleaning member, operatively associated with the screen member, is mounted movably in the printing machine. Means are provided for moving the cleaning member across the screen member to remove contaminants therefrom.

BRIEF DESCRIPTION OF THE DRAWINGS

Other objects and advantages of the present invention will become apparent upon reading the following detailed description and upon reference to the drawings, in which.

While the present invention will be described in connection with preferred embodiments thereof, it will be understood that it is not intended to limit the invention to these embodiments. On the contrary, it is intended to cover all alternatives, modifications and equivalents as may be included within the spirit and scope of the invention as defined by the appended claims.

DETAILED DESCRIPTION OF THE INVENTION

Figure 1:
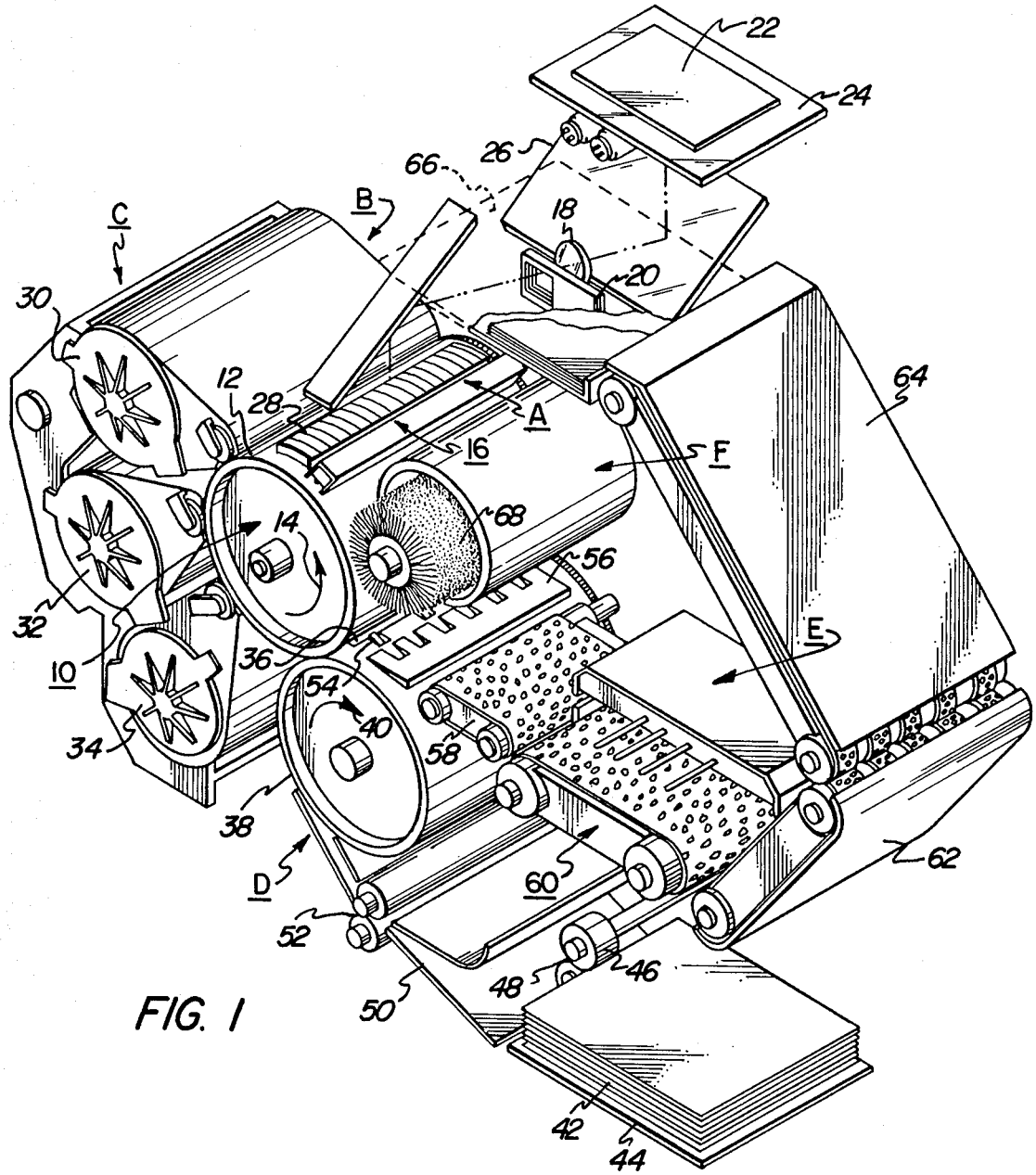
FIG. 1 is a schematic perspective view of an electrophotographic printing machine incorporating the features of the present invention therein.

A general understanding of an electrophotographic printing maching having the features of the present invention incorporated therein may be had by referring to FIG. 1. In all of the drawings, like reference numerals have been used throughout to designate like elements. Although the apparatus of the present invention is shown as being incorporated into the FIG. 1 printing machine, it will be obvious to one skilled in the art that the features of the present invention are not limited to this printing machine but may be incorporated into other devices. Thus, the electrophotographic printing machine depicted in FIG. 1 is merely exemplary of one use for the apparatus of the present invention.

Turning now to FIG. 1, the electrophotographic printing machine includes a rotatable drum 10 having a photoconductive surface 12 entrained thereabout and secured thereto. Drum 10 is mounted rotatably on a shaft (not shown) and rotates in the direction of arrow 14. This moves photoconductive surface 12 sequentially through a series of processing stations. Preferably, photoconductive surface 12 is made from a suitable polychromatic selenium alloy such as is described in U.S. Pat. No. 3,655,377 issued to Sechak in 1972. A timing disc, rotating in synchronism with drum 10, cooperates with a light source and photosensor to produce electrical pulses. These electrical pulses are processed by the machine logic to activate each process station at the appropriate time.

For purposes of the present disclosure, the various processing stations employed in the printing machine will be briefly described hereinafter.

The machine cycle is initiated when drum 10 passes through charging station A as it rotates in the direction of arrow 14. Charging station A includes a corona generating device, indicated generally by the reference numeral 16. Photoconductive surface 12 is charged to a relatively high substantially uniform level by corona generating device 16. Preferably, corona generating device 16 extends in a generally transverse direction across photoconductive surface 12 to produce a spray of ions for the charging thereof. U.S. Pat. No. 2,778,946 issued to Mayo in 1957 describes a suitable corona generating device.

Figure 2:
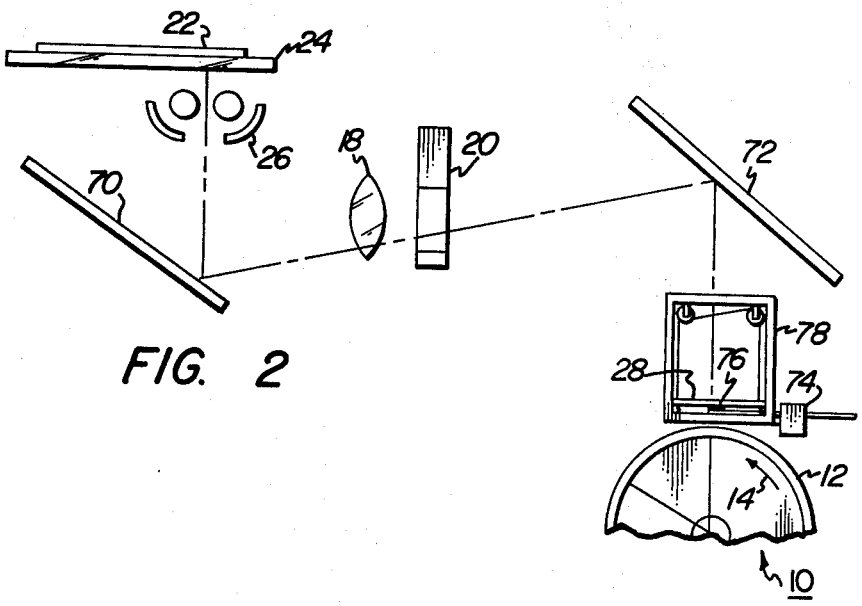
FIG. 2 is an elevational view of the embodiment of the exposure system employed in the FIG. 1 electrophotographic printing machine.

After photoconductive surface 12 is charged, the charged portion thereof is advanced by the rotation of drum 10 to exposure station B. At exposure station B, the charged portion of photoconductive surface 12 is exposed to a color filtered light image of the original document. A moving lens system, generally designated by the reference numeral 18, and a color filter mechanism, shown generally at 20, are positioned at exposure station B. A suitable moving lens system is described in U.S. Pat. No. 3,062,108 issued to Mayo in 1952. Similarly, a suitable color filter mechanism is described in U.S. Pat. No. 3,775,006 issued to Hartman et al. in 1973. Original document 22 is disposed on transparent viewing platen 24. Lamp assembly 26 is located beneath transparent viewing platen 24, and, in conjunction with lens 18 and filter 20, moves in a timed relationship with drum 10. In this way, successive incremental areas of original document 22 are scanned. Preferably, lens 18 is a six element split dagor lens having front and back compound components with a diaphragm located centrally therebetween. The front lens component includes three elements; a first lens element *i* of positive power, a second lens element *i* of negative power cemented to the first lens element, and a third lens element *i* of positive power interposed between the second lens element and diaphragm. Preferably, the first lens element has a double convex lens as the front component, a concave lens as the second component, and a convex-concave lens as the third component. Lens 18 will have a speed ranging from about F/4.5 to about F/8.0. A suitable color corrected type of lens is described in U.S. Pat. No. 3,592,531 issued to McCrobie in 1971. In this manner, a single color flowing light image of an original document 22 is produced. This single color light image may be transmitted through screen member 28, as shown in FIGS. 1 and 2. In an alternate embodiment (FIG. 3), screen member 28 is positioned prior to or subsequent to the optical light path. In this latter embodiment, the screen pattern formed on the charged portion of photoconductive surface is in superimposed registration with the electrostatic latent image of the original document recorded thereon. Both of the foregoing embodiments will be discussed hereinafter in greater detail with reference to FIGS. 2 and 3. Preferably, screen member 28 is made from a transparent sheet such as glass having a plurality of equally spaced opaque lines or dots thereon. The detailed structure of screen member 28 will be discussed hereinafter with reference to FIG. 4.

Successive color filters operate on the light rays passing through lens 18 to create a modulated single color light image which records a modulated single color electrostatic latent image on photoconductive surface 12. This modulated single color latent image corresponds to a pre-selected region of the electromagnetic wave spectrum. Screen member 28 is mounted movable in the printing machine. This enables the spacing between photoconductive surface 12 and screen member 28 to be adjustable. In this way, the resultant contrast of the copy is regulated.

After the electrostatic latent image is recorded on photoconductive surface 12, drum 10 rotates to development station C. At development station C, three developer units, generally indicated by the reference numerals 30, 32 and 34 render successive single color electrostatic latent images visible. A suitable development station employing a plurality of developer units (in this case three) is described in U.S. Pat. No. 3,854,449 issued to Davidson in 1974. The developer units described therein are magnetic brush developer units. A typical magnetic brush developing unit employs a magnetizable developer mix of carrier granules and toner particles. The developer unit forms a directional flux field to continually create a brush of developer mix. This brush of developer mix is brought into contact with the modulated single color electrostatic latent image recorded on photoconductive surface 12. Toner particles adhering electrostatically to the carrier granules of the developer mix are attracted by the greater elecrostatic force of the latent image thereto to render it visible.

Developer units 30, 32, and 34, respectively, contain differently color toner particles therein. Each of the toner particles in the respective developer unit correspond to the compliment of the single color light image transmitted through each of three differently colored filters. For example, a modulated electrostatic latent image formed from a green filtered light image is rendered visible by depositing green absorbing magenta toner particles thereon. Similarly, electrostatic latent images formed from blue and red light images are developed with yellow and cyan colored toner particles, respectively.

After the modulated electrostatic latent image recorded on photoconductive surface 12 is developed, drum 10 rotates to transfer station D. At transfer station D, the toner powder image adhering electrostatically to photoconductive surface 12 is transferred to a sheet of support material 36. A transfer roll, shown generally by the reference numeral 38, recirculates support material 36. Transfer roll 38 is electrically biased to a potential of sufficient magnitude and polarity to electrostatically attract toner particles from photoconductive surface 12 to support material 36. Successive toner powder images are transferred from photoconductive surface 12 to support material 36, in superimposed registration with one another. This is achieved by having transfer roll 38 rotate in synchronism with drum 10 in the direction of arrow 40. Thus, transfer roll 38 and drum 10 rotate at the same tangential velocity. A suitable electrically biased transfer roll is described in U.S. Pat. No. 3,612,677 issued to Langdon et al. in 1971.

Prior to proceeding with the remaining processing stations, the sheet feeding path will be briefly described hereinafter. Support material 36 is advanced from stack 42 disposed upon tray 44. This is achieved by a feed roll 46 operatively associated with a retard roll 48. Feed roll 46 advances successive uppermost sheets from stack 42 into chute 50. Chute 50 guides the advancing sheet into the nip between register rolls 52. Register rolls 52 align and forward the advancing sheet at the appropriate time to transfer roll 38. Gripper fingers 54, disposed upon transfer roll 38, secure the advancing sheet thereto. After the requisite number of toner powder images have been transferred to support material 36, gripper fingers 54 space support material 36 from transfer roll 38. As transfer roll 38 continues to rotate in the direction of arrow 40, stripper bar 56 is interposed therebetween. Support material 36 passes over stripper bar 56 onto conveyor 58. Conveyor 58 forwards the sheet of support material 36, with the multi-layered toner pattern image thereon, to fixing station E.

At fixing station E, a fuser, indicated generally by the reference numeral 60, permanently affixes the transferred toner powder images to support material 36. One type of suitable fuser is described in U.S. Pat. No. 3,826,892 issued to Draugelis in 1974. After the fixing process, sheet 36 is advanced by endless belt conveyors 62 and 64 to catch tray 66 for subsequent removal therefrom by the machine operator.

Frequently, residual toner particles adhere to photoconductive surface 12 after the transfer process. Cleaning station F, the final processing station in the direction of rotation of drum 10 as indicated by arrow 14, removes the residual toner particles from photoconductive surface 12. A pre-clean corona generating device (not shown) neutralizes the charge on photoconductive surface 12 and that of the residual toner particles. This enables fibrous brush 68, in contact with photoconductive surface 12, to remove the residual toner particles therefrom. U.S. Pat. No. 3,590,412 issued to Gerbasi in 1971 describes a suitable brush cleaning system.

It is believed that the foregoing description is sufficient for purposes of the present application to describe the features of the electrophotographic printing machine in which the present invention is incorporated.

Referring not to FIG. 2, there is shown one embodiment of exposure station B. As shown thereat, lens 26 move across platen 24 with original document 22 disposed face down thereon. The light rays reflected from original document 22 pass through transparent platen 24 onto mirror 70. Mirror 70 reflects light rays through lens 18 which forms a flowing light image thereof. The flowing light image is then transmitted through the appropriate filter of filter mechanism 20 to produce a single color flowing light image. This single color flowing light image is reflected by mirror 72 through screen member 28 forming a modulated single color flowing light image. The modulated single color light image thereupon irradiates the charged portion of photoconductive surface 12. This selectively discharges photoconductive surface 12 to record thereon a modulated single color electrostatic latent image.

Figure 4:
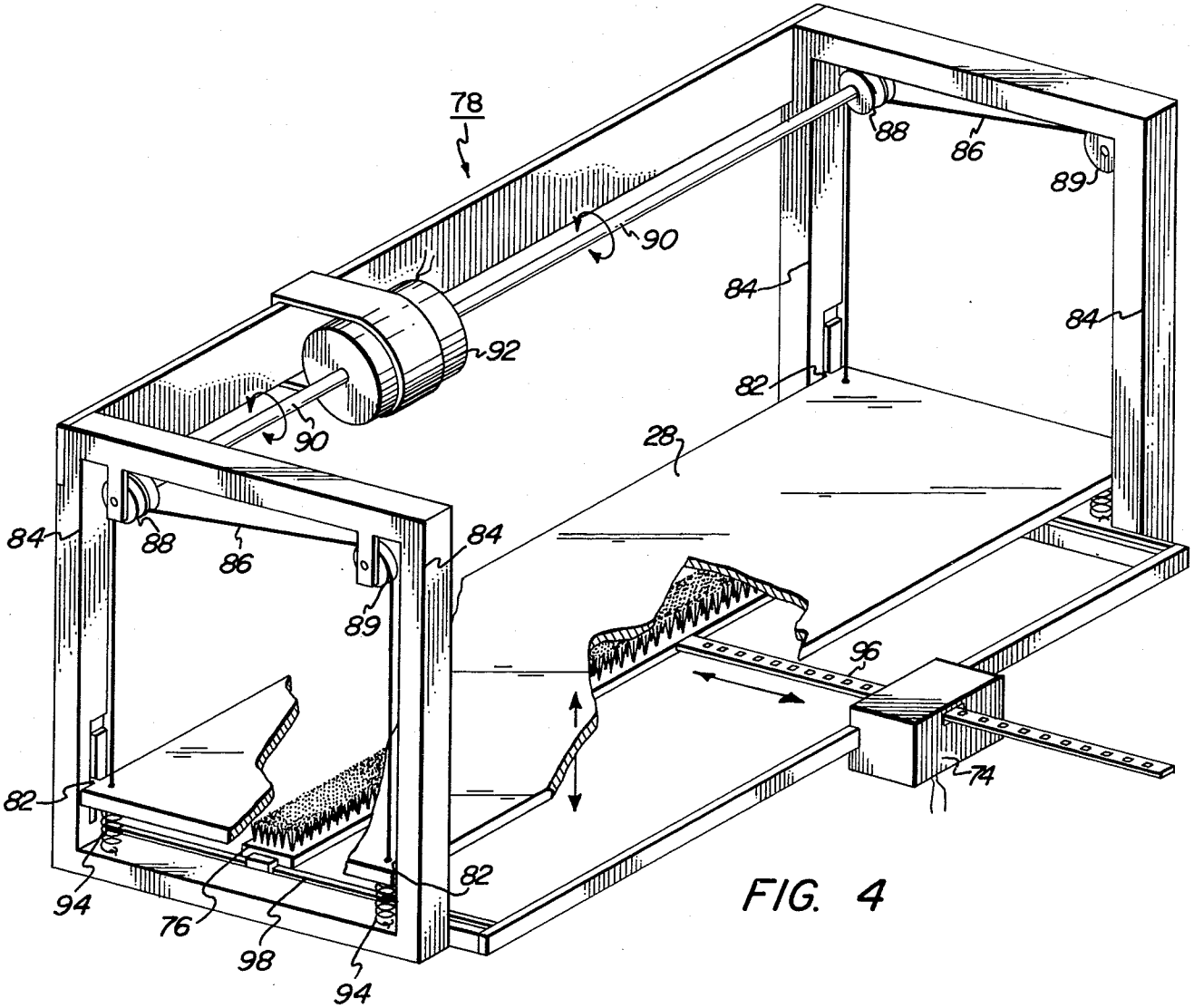
FIG. 4 is a perspective view of the screen moving and cleaning mechanism employed in the FIG. 1 printing machine exposure system.

In this mode of operation, contrast may be adjusted by moving screen member 28 relative to photoconductive surface 12 so as to adjust the spacing therebetween. The detailed structure of the mechanism for adjusting the spacing between screen member 28 and photoconductive surface 12 is illustrated in FIG. 4 and will be discussed hereinafter with reference thereto. In addition, drive motor 74 reciprocates brush 76 so as to periodically remove contaminants from the surface of screen member 28. Brush 76 extends a distance equal to the length of screen member 28 and is arranged substantially parallel to the longitudinal axis thereof. Thus, drive motor 74 reciprocates brush 76 which is mounted slidably in housing 78 so as to move across screen member 28. In this way, toner particles or other dirt contaminants are removed therefrom.

Figure 3:
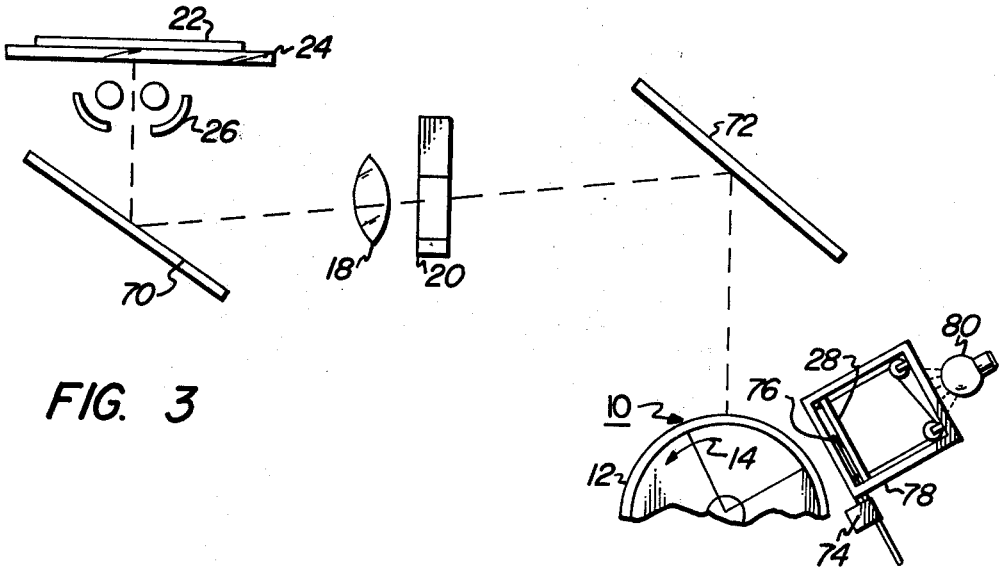
FIG. 3 is an elevational view of another embodiment of the exposure system employed in the FIG. 1 printing machine.

Referring now to FIG. 3, there is shown another embodiment of exposure station B. As shown in FIG. 3, screen member 28 is positioned at exposure station B prior to the path of the light image. It should be noted that in this mode of operation, screen member 28 may be located either prior to or subsequent to the light image optical path. Once again, lamps 26 move across platen 24 scanning original document 22. The light rays reflected from original document 22 are, in turn, reflected by mirror 70 through lens 18 forming a flowing light image thereof. This flowing light image passes through one of the color filters of filter mechanism 20 forming a single color flowing light image. The single color flowing light image is reflected by mirror 70 onto photocondutive surface 12. The flowing light image irradiates the portion of photoconductive surface 12 having a screen pattern recorded thereon. In the event that the screen is located after the formation of the flowing light image, the screen light pattern is projected in superimposed registration with the electrostatic latent image recorded on photoconductive surface 12. The screen pattern is formed by screen member 28 having light rays from light source or lamp 80 passing therethrough and irradiating photoconductive surface 12 prior to or subsequent to the formation of the electrostatic latent image of the original document. Once again, copy contrast may be adjusted by regulating the spacing between screen member 28 and photoconductive surface 12. To this end, screen member 82 is mounted movably in housing 78. The spacing between photoconductive surface 12 and screen member 28 is adjusted by controlling the movement of screen member 28 in housing 78. Brush 76 is mounted slidably in housing 78 and is periodically reciprocated across screen member 28 by drive motor 74. In this way, particles, such as toner or dirt, accumulating on screen member 28 are removed therefrom. Hence, modulation is achieved by the formation of a screen pattern on the photoconductive surface in superimposed registration with a latent image of the original document. Thereafter, the modulated electrostatic latent image is rendered visible by the development process heretofore described.

Referring not to FIG. 4, there is shown a detailed description of the mechanism for cleaning screen member 28 and adjusting the spacing between screen member 28 and photoconductive surface 12. Screen member 28 includes a pair of opposed rods 82 at either marginal edge thereof. In this manner, screen member 28 is mounted slidably on rails 84 of housing member 78. Flexible cable 86 is entrained about pulleys 88 and 89 and secured at the lower portions thereof to screen member 28. Drive shaft 90 of motor 92 is attached to pulley 88. Actuation of motor 92 rotates drive shaft 90 winding cables 96 about pulley 88. This, raises screen member 28 and increases the spacing between screen member 28 and photoconductive surface 12. As screen member 28 moves in a upwardly direction springs 94 are extended. Thus,, springs 94 resiliently pull screen member 28 in a downwardly direction. As drive motor 92 rotates in the opposite direction, cables 86 unwind from pulley 88 and springs 94 pull screen member 28 in a downwardly direction to decrease the spacing between photoconductive surface 12 and screen member 28. Thus, it is seen that the mechanism of the present invention readily adjusts the spacing between photoconductive surface 12 and screen member 28.

With continued reference to FIG. 4, brush 76 which includes a plastic holder having a plurality of substantially stiff bristles extending outwardly therefrom and contacting the under surface of screen member 28 extends in a longitudinal direction along the length of screen member 28. Rod 96 is secured to drive motor 74. Actuation of drive motor 74 causes rod 96 to reciprocate. Reciprocation or rod 96 slides brush 76 across screen member 28 removing particle contaminants thereon. It should be noted that brush 76 is mounted slidably on rail 98. Rail 98 and screen member 28 define a slot with brush member 76 mounted slidably therein. Actuation of drive motor 74 reciprocates shaft 96, which, in turn, reciprocates brush 76 across screen member 28 removing particle contaminants therefrom.

Preferably, screen member 28 is formed on a transparent substrate such as glass. A plurality of lines or dots are printed on the substrate by a suitable chemical etching technique, or by a photographic technique. The screen itself may be made from any number of opaque metallic materials suitable for chemical etching such as copper or aluminum. The screen size may be varied and the finer the size the more natural or higher quality the copy. Thus, while a coarse screen having 50 to 60 lines or dots per inch will be useful for some purposes, finer screens such as those having anywhere from 100 to 400 or more lines or dots per inch will give a more nearly continuous tone appearance to the finished copy. With finer screens, the screen pattern may be bearly perceptible on the finished copy and the copy will have the appearance of a continuous tone photograph. While screens having a plurality of equally spaced opaque lines or dots thereon have been described, other screens having squares, or checkerboard patterns may also be employed.

In recapitulation, it is evident that the electrophotographic printing machine of the present invention incorporates a movable screen arranged to be periodically cleaned. Movement of the screen member adjusts the spacing between the photoconductive surface and the screen member so as to regulate the resultant contrast of the copy. Cleaning of the screen member is achieved with the screen member in the operative position.

It is, therefore, apparent that there has been provided in accordance with the present invention an electrophotographic printing machine that fully satisfies the objects, aims and advantages hereinbefore set forth. While the present invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. An electrophotographic printing machine of the type having a photoconductive member, including:

a screen member mounted movably in the printing machine and positioned closely adjacent to the photoconductive member;

means for adjusting the spacing between said screen member and the photoconductive member;

a cleaning member mounted movably in the printing machine and operatively associated with said screen member; and means for moving said cleaning member across said screen member to remove contaminants therefrom.

2. A printing machine as recited in claim 1, further including:

means for charging the photocondutive member to a substantially uniform potential; and means for projecting a light image of an original document through said screen member onto the charged portion of the photoconductive member to discharge selectively the charge recording a modulated electrostatic latent image thereon.

3. A printing machine as recited in claim 2, further including:

means for developing the modulated electrostatic latent image recorded on the photoconductive member with charged particles;

means for transferring the charged particles from the photoconductive member to a sheet of support material in image configuration; and means for permanently affixing the charged particles to the sheet of support material producing a copy of the original document.

4. A printing machine as recited in claim 3, wherein said projecting means includes means for filtering successive light images with differently colored filters so as to record successive modulated single color electrostatic latent images on the photoconductive member.

5. A printing machine as recited in claim 4, wherein:

said developing means develops each modulated single color electrostatic latent image with charged particles of a color complementary to the color of the corresponding single color light image;

said transferring means transfers successive differently colored charged particles to the sheet of support material in superimposed registration with one another; and said fixing means permanently affixes the differently colored charged particles to the sheet of support material forming a colored copy of the original document.

6. A printing machine as recited in claim 5, wherein said cleaning member includes a brush in contact with said screen member and mounted slidably in the printing machine.

7. A printing machine as recited in claim 6, wherein said moving means includes drive means coupled to said brush for reciprocating automatically periodically said brush across said screen member.

8. A printing machine as recited in claim 1, further including:

means for charging the photoconductive member to a substantially uniform potential;

a light source in communication with said screen member for directing light rays therethrough onto the photoconductive member; and means for projecting a light image of an original document onto the photoconductive member, the light rays passing through said screen member and the light image being in superimposed registration with one another on the charged portion of the photoconductive member recording a modulated electrostatic latent image thereon.

9. A printing machine as recited in claim 8, further including:

means for developing the modulated electrostatic latent image recorded on the photoconductive member with charged particles;

means for transferring the charged particles from the photoconductive member to a sheet of support material in image configuration; and means for permanently affixing the charged particles to the sheet of support material producing a copy of the original document.

10. A printing machine as recited in claim 9, wherein said projecting means includes means for filtering successive light images with differently colored filters so as to record successive modulated single color electrostatic latent images on the photoconductive member.

11. A printing machine as recited in claim 10, wherein:

said developing means develops each modulated single color electrostatic latent image with charged particles of a color complementary to the color of the corresponding single color light image;

said transferring means transfers successive differently colored charged particles to the sheet of support material in superimposed registration with one another; and said fixing means permanently affixes the differently colored charged particles to the sheet of support material forming a colored copy of the original document.

12. A printing machine as recited in claim 11, wherein said cleaning member includes a brush in contact with said screen member and mounted slidably in the printing machine.

13. A printing machine as recited in claim 12, wherein said moving means includes drive means coupled to said brush for reciprocating automatically periodically said brush across said screen member.

* * * * *